United States Patent [19]

Carrubba et al.

[11] 4,054,407

[45] Oct. 18, 1977

[54] METHOD OF COMBUSTING NITROGEN-CONTAINING FUELS

[75] Inventors: Robert V. Carrubba, Bridgewater; Ronald M. Heck, Frenchtown; George W. Roberts, Westfield, all of N.J.

[73] Assignee: Engelhard Minerals & Chemicals Corporation, Iselin, N.J.

[21] Appl. No.: 644,868

[22] Filed: Dec. 29, 1975

[51] Int. Cl.[2] ..... F23M 3/04

[52] U.S. Cl. ..... 431/10; 431/11

[58] Field of Search ..... 431/2, 6, 10, 9, 351, 431/352, 165, 11; 60/39.02, 39.06

[56] References Cited

U.S. PATENT DOCUMENTS

| | | | |
|---|---|---|---|
| 3,837,788 | 9/1974 | Craig et al. | 431/10 X |
| 3,914,090 | 10/1975 | Pfefferle | 431/9 |
| 3,914,091 | 10/1975 | Yamagishi | 431/10 |
| 3,928,961 | 12/1975 | Pfefferle | 60/39.02 |
| 3,940,923 | 3/1976 | Pfefferle | 60/39.06 |

*Primary Examiner*—Edward G. Favors

[57] ABSTRACT

A method for combusting nitrogen-containing fuel by: combusting a first fuel-air mixture in the presence of a catalyst in a first stage, operated fuel-rich so that the amount of air in the first stage is substantially less than the amount needed for complete combustion; adding additional air to the effluent gas from the first stage to form a second mixture with an amount of air at least sufficient to combust fully the effluent from the first stage; and then combusting the second mixture in a second stage. The first mixture is sufficiently fuel-rich, and the second mixture contains sufficient additional air, so that the combustion temperature in the first stage is below a temperature that would result in any substantial formation of oxides of nitrogen or other fixed nitrogen compounds from atmospheric nitrogen present in the mixture being combusted, and the second stage temperature also is below that for substantial nitrogen oxide formation therefrom. The method serves to suppress formation of nitrogen oxides from the nitrogen-containing compounds in the fuel.

23 Claims, 3 Drawing Figures

TWO STAGE COMBUSTION OF FUEL CONTAINING 0.17 WT.% OF A NITROGEN COMPOUND

FIRST STAGE FUEL RICH AND SECOND STAGE FUEL LEAN (AIR/FUEL) WEIGHT RATIO=38

——— AVERAGE $NO_x$ FROM TWO STAGE COMBUSTION TESTS

- - - - - AVERAGE $NO_x$ IF 100% OF NITROGEN COMPOUND IN FUEL CONVERTED TO $NO_x$

TWO STAGE COMBUSTOR FLOW CHART

METHOD OF COMBUSTING NITROGEN-CONTAINING FUELS

BACKGROUND OF THE INVENTION

This invention relates to a method for combusting fuels which include nitrogen-containing compounds so that formation of nitrogen oxides ($NO_x$) from such compounds, which ordinarily tends to occur during combustion, is suppressed materially.

In general, nitrogen oxides are formed as by-products of combustion processes carried out with air at relatively high temperatures. As used herein and in the appended claims, the term air means any gas or combination of gases containing oxygen available for combustion reactions and also containing ordinarily inert materials including nitrogen gas. The term stoichiometric amount of air means that amount of air which is theoretically sufficient for complete oxidation of all the combustible components in a given amount of fuel (e.g., to carbon dioxide and water). Particularly in combustors used in furnaces, boilers, process drying equipment, and gas turbines, in which peak combustion temperatures typically exceed about 3,200° F, atmospheric nitrogen in the feed to the combustors is oxidized to produce relatively large amounts of nitrogen oxides. As a result, the conventional high temperature combustors used for producing heat and power in modern technology have tended to cause the accumulation of nitrogen oxides in the atmosphere. In fact, the discharge of nitrogen oxides from various sources has become an environmental hazard, especially in urban areas. For this reason, governmental agencies are concerned with more or less stringent nitrogen oxide emission standards for all combustion equipment.

The difficulties in minimizing nitrogen oxide emissions have been aggravated by the energy crisis. This has resulted from diminished supplies of relatively clean-burning hydrocarbon fuels, e.g., natural gas, which has made the use of so-called "dirty" fuels more attractive or even a necessity. The "dirty" fuels, such as coal gas, number 6 diesel fuel, shale oil, and of course coal-derived liquid fuels, have typically contained, as impurities, sizable amounts of fuel nitrogen, i.e., nitrogen-containing compounds, as for example ammonia in coal gas, and cyclic and polycyclic nitrogen compounds, e.g., compounds in the carbazole, pyridine, indole, and aniline families, in some liquid fuels. In combustors generally, a substantial portion of the fuel nitrogen in "dirty" fuels is oxidized and converted to nitrogen oxides. The combination of the oxidation of atmospheric nitrogen and the oxidation of nitrogen-containing compounds originating in fuels has tended to produce undesirably high nitrogen oxide levels in the effluents of conventional, high temperature combustors, burning "dirty" fuels. Hence efficient combustion methods have been sought in which the oxidation of nitrogen-containing compounds in "dirty" fuels to nitrogen oxides is inhibited and, at the same time, the formation of nitrogen oxides from atmospheric nitrogen is inhibited or substantially avoided.

One proposal for minimizing such formation of nitrogen oxides involves operating a fire tube boiler with combustion of the fuel in two stages, the boiler being extended somewhat to provide two axially aligned combustion chambers. (Paper by D. W. Turner and C. W. Siegmund, "Staged Combustion and Flue Gas Recycle: Potential for Minimizing $NO_x$ from Fuel Oil Combustion", presented at The American Flame Research Committee Flame Days, Chicago, Ill., Sept. 6–7, 1972). To aid in limiting total formation of nitrogen oxides from nitrogen-containing compounds in the fuel as well as from atmospheric nitrogen in the combustion air, it was proposed to operate the first stage moderately fuel-rich; some excess air is added to the partially combusted effluent, and the remaining uncombusted fuel is burned in the second stage. The modified boiler was tested by progressively decreasing the rate of air supply to the first stage relative to the rate of fuel feed. As the air supply rate is decreased from a little excess air, through the stoichiometric amount, and somewhat into the fuel-rich region, the total amount of nitrogen oxides formed decreases although combustion zone temperatures remain high. As the feed is made still more fuel-rich, nitrogen oxide formation continues to decrease. However, as this occurs, combustion zone temperatures also decrease more and more sharply, and the combustion in the first stage becomes increasingly unstable as the operating region is approached (at an amount of air equal to about 0.8 to 0.7 times that needed for complete combustion) where the largest decreases in total nitrogen oxide formation are achieved in spite of the presence of substantial amounts of nitrogen-containing compounds in the fuel. Thus, to realize the benefits of desirably low nitrogen oxide formation, it becomes necessary to sacrifice combustion stability and dependability or to maintain stability by other means, such as vigorous circulation within the combustion zone, or sharp limitation of the space velocity of the fuel-air mixture passed through the combustion zone. Unfortunately, the alternative of operating at higher air-fuel ratios in order to improve combustor stability results in rather sharp increases of total nitrogen oxides formed. Accordingly, a method of achieving combustion with dependable stability, even at high throughput rates, and without excessive total formation of nitrogen oxides from fuel nitrogen as well as atmospheric nitrogen, would be useful and desirable.

A particularly attractive method for avoiding substantial formation of nitrogen oxides from atmospheric nitrogen in the combustion of fuels to generate heat and power has been disclosed in U.S. patent application Ser. No. 358,411, filed May 8, 1973, in the name of William C. Pfefferle and assigned to the same assignee as that of the present invention, entitled "Catalytically Supported Thermal Combustion", now U.S. Pat. No. 3,928,961, which is incorporated by reference in the present application. The method of this earlier application, employing a catalyst operating under specified conditions in the combustion zone, may be used advantageously in carrying out a preferred embodiment of the method of the present invention. Another U.S. patent application of William C. Pfefferle, Ser. No. 519,288, filed Oct. 30, 1974, entitled "Method and Apparatus for Turbine System Combustor Temperature Control", and also assigned now U.S. Pat. No. 3,975,900, to the same assignee as that of the present invention, discloses a method of controlling a combustor, which feeds a gas turbine, to maintain constant operating temperature of a catalyst in the combustion zone. This application mentions a number of fuels typically low in nitrogen-containing compounds, exemplified by commercial gasoline, naphtha, and propane, and describes combustion temperature control by automatic adjustments in the fuel-air mixtures which are chosen to remain sufficiently fuel-lean or fuel-rich to burn at temperatures of the order of 3,200° F or lower in the presence of the catalyst. When fuel-rich mixtures are used in such a method, application Ser. No. 519,288 notes that the partially oxidized effluent can be mixed with additional air and thermally combusted downstream of the catalyst.

SUMMARY OF THE INVENTION

In accordance with this invention, the method of combusting nitrogen-containing fuel while suppressing formation of oxides of nitrogen from said nitrogen contained in the fuel comprises forming a first mixture of the fuel and an amount of air substantially less than the amount needed for complete combustion of all the combustible components in the fuel, and combusting this first mixture in a first combustion zone in the presence of a catalyst, having an operating temperature below a temperature that would result in any substantial formation of oxides of nitrogen or other fixed nitrogen compounds from atmospheric nitrogen present in the mixture, to form a first effluent. The first effluent is mixed with an additional amount of air at least sufficient for complete combustion of all combustible components remaining in the first effluent to form a second mixture, which is combusted in a second combustion zone below a temperature that would result in any substantial formation of oxides of nitrogen from atmospheric nitrogen.

In accordance with a preferred aspect of the invention, the first mixture of fuel and air is formed in intimate admixture and likewise includes an amount of air substantially less than the amount needed for complete combustion of all the combustible components in the fuel. This first mixture is combusted under essentially adiabatic conditions in the first combustion zone in the presence of a catalyst to form a first effluent, the combustion in the first combustion zone being characterized by the first mixture having an adiabatic flame temperature such that, upon contact with the catalyst, the operating temperature of the catalyst is substantially above the instantaneous auto-ignition temperature of the first mixture but below a temperature that would result in any substantial formation of oxides of nitrogen or other fixed nitrogen compounds from atmospheric nitrogen present in the mixture, thereby effecting sustained combustion of a portion of the fuel at a rate surmounting the mass transfer limitation. This first effluent again is mixed with an additional amount of air at least sufficient for complete combustion to form a second mixture, which is combusted in a second combustion zone below a temperature that would result in any substantial formation of oxides of nitrogen from atmospheric nitrogen; combustion in the second combustion zone also may be carried out, if desired, in the presence of a catalyst.

DETAILED DESCRIPTION OF THE INVENTION

Figure 1:
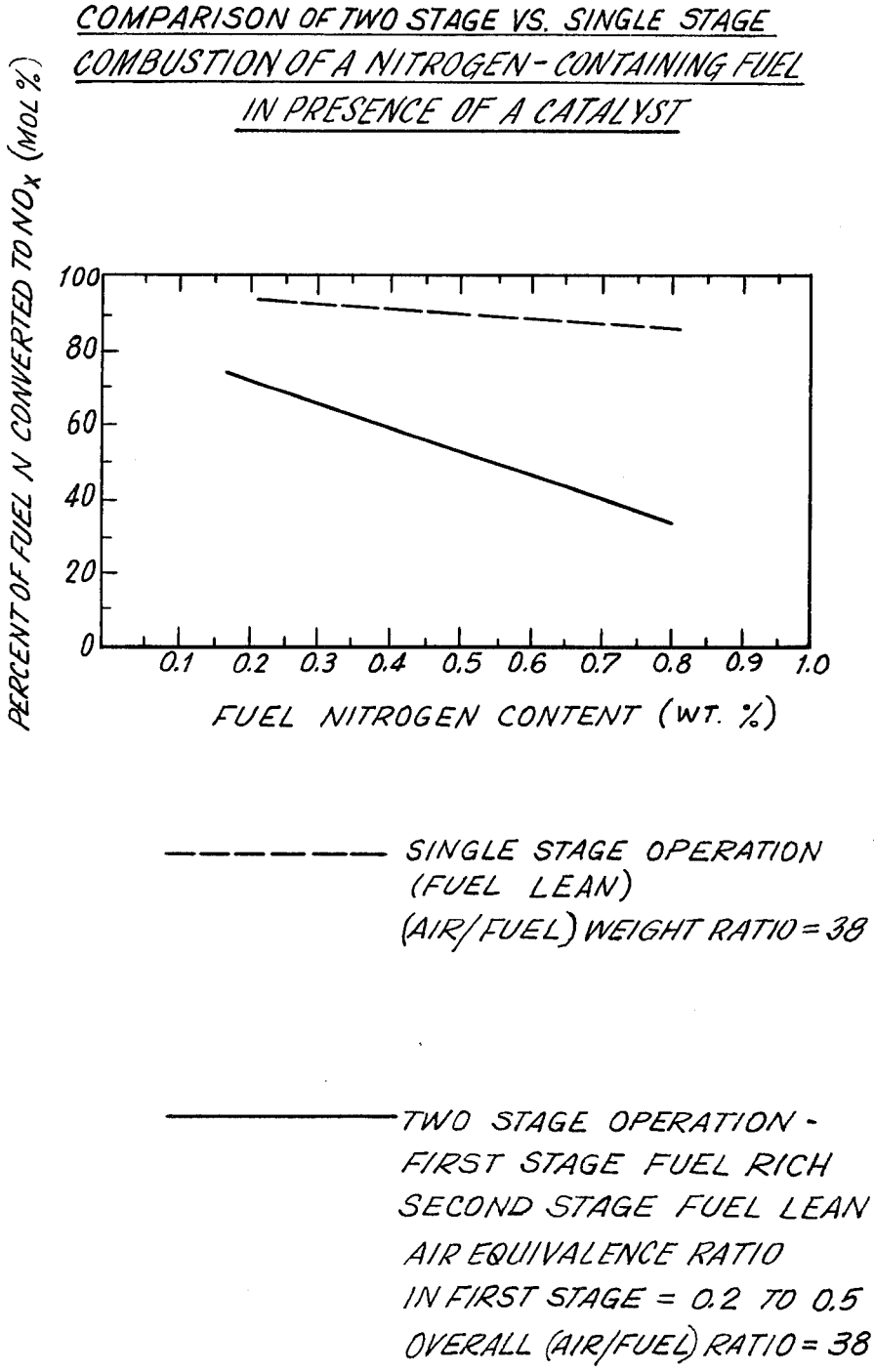
FIG. 1 is a graph comparing the production of nitrogen oxides ($NO_x$) from fuel nitrogen by a two stage combustion, in accordance with this invention, with a single stage combustion using an intimate admixture of fuel and air under fuel-lean conditions in the presence of a catalyst, in accordance with the process of the aforementioned Pfefferle application Ser. No. 519,288. For the comparison the two stage combustion was carried out with a catalyst of high activity and thermal stability in the first stage and a similar catalyst with adequate activity and thermal stability in the second.

The two stage combustion, in accordance with this invention, of a nitrogen-containing fuel involves a first combustion stage or zone including a catalyst; a second combustion stage or zone; provision of a fuel-rich fuel-air mixture as the feed to the first stage; and supplying additional air to the effluent from the first stage to provide an amount of air at least sufficient for complete combustion. In addition, if desired, there may be preheating of the fuel-air feed to the first combustion stage; preheating of the additional air added to the first stage effluent; thermal preburning to preheat the mixture entering the first combustion stage, with or without injecting additional fuel prior to entering the first stage; cooling of one or both of the combustion stages; cooling of the effluent gas from one or both of the combustion stages; and recycling of a portion of the effluent gas from the second stage to the inlet of the first stage or to the inlet of the second stage or both after removal of energy from the effluent leaving the combustion apparatus.

As an example of suitable cooling and recycling steps, it may prove to be especially advantageous to cool the final effluent from the second stage, and to recycle a portion of this cooled second stage effluent as a part or all of the air mixed with the first stage effluent. Another expedient which may prove particularly advantageous is to cool the effluent from the first stage before passing it to the second stage. This cooling may be effected before, during, or after mixing of air, or recycle gas, or both with the first stage effluent. Preferably the effluent is cooled as it leaves the first stage by heat transfer to utilize its thermal energy. This expedient is particularly useful when the overall air-fuel ratio is close to stoichiometric, as for instance when the two stage combustion is used to operate a furnace or boiler, as means for maintaining the second stage combustion zone temperature below nitrogen-oxide-forming temperatures.

As used in this specification and in the appended claims, the term "nitrogen-containing fuel" encompasses a combustible fuel containing a substantial amount of an oxidizable, nitrogen-containing compound; for this purpose, elemental nitrogen, $N_2$, and nitrogen oxides themselves are not viewed as oxidizable, nitrogen-containing compounds. Ordinarily a fuel containing less than about 0.05% by weight of nitrogen present in such nitrogen-containing compounds would not be considered to be a nitrogen-containing fuel. Among the fuels which can be utilized in the feed are hydrogen, such as found in purge gas from the synthesis loop in ammonia plants, and the hydrocarbons and related carbonaceous fuels, for example, the low Btu gaseous fuels such as coal gas and synthesis gas; and liquid fuels such as diesel fuel, heavier distillates, and coal-derived liquid fuels; and partial oxidation products of any of these fuels. These fuels frequently include nitrogen-containing combustible compounds which originate with the natural crude fuel and which are expensive or difficult to remove from the fuel prior to use. This is true of the more abundant liquid fuels, as discussed below, and coal gas and synthesis gas also frequently include substantial amounts of gaseous nitrogen-containing compounds in the form of ammonia and hydrogen cyanide. Any gaseous or liquid fuel feed may have become contaminated with nitrogen-containing compounds. Nitrogen commonly occurs in the form of oxidizable, nitrogen-containing compounds in available "dirty" fuels, which may be combusted readily in accordance with the method of the present invention, in amounts of about one twentieth percent to about one percent by weight computed as nitrogen. Combustion of fuels which include nitrogen-containing compounds in smaller amounts ordinarily would not cause serious pollution due to conversion of the nitrogen in such compounds to nitrogen oxides. Also, the method of the present invention can be effective in avoiding extensive conversion to nitrogen oxide pollutants of nitrogen originating in nitrogen-containing compounds present in fuels quite high in such nitrogen, such as shale oil, and in fuels somewhat higher in nitrogen than one percent, notably heavy synthetic liquid fuels derived from coal as by pyrolysis, hydrogenation, or extraction. For purposes of illustration and comparison, extensive tests have been carried out, and are discussed hereinbelow, on fuels containing somewhat over 0.1 percent nitrogen and on other fuels containing on the order of one percent nitrogen, the utilization of such fuels in low pollution combustion systems being of pressing interest under present conditions of fuel availability and cost.

Nitrogen commonly occurs in liquid fuels as heterocyclic nitrogen compounds. For example, a California crude oil has been found to include nitrogen, in percent by weight of nitrogen itself in the fuel, as carbazole and substituted carbazoles in the order of 0.3 percent, as quinolines and pyridines each in the order of 0.2 percent, and as indoles in the order of 0.1 percent. Pyridine, for example can be expected to form amines on cracking, and on heating will form ammonia and hydrogen cyanide. At typical combustion temperatures pyridine breaks down to form a chain of ethylenic carbon atoms containing, and usually terminated by, nitrogen, and further cleavage readily occurs to give products such as acetonitrile, acrylonitrile, and hydrogen cyanide. These and other intermediate products of pyrolysis in turn tend to form nitric oxide rapidly in an oxidizing atmosphere at ordinary combustion temperature levels. Thus pyridine exemplifies the ozidizable, nitrogen-containing compounds found in liquid "dirty" fuels which tend to produce undesirable atmospheric pollutants when burned.

Experiments have shown that addition of equivalent amounts of pyridine, piperidine (saturated pyridine), or quinoline, for example, to a substantially nitrogen-free fuel provides essentially the same yields of nitric oxide under the same combustion conditions as with fuels containing the naturally occurring pyridines or quinolines. Similarly, ammonia and the amines such as methylene, ethylamine, diethylamine, and aniline, which also may be found in fuel feeds, form nitric oxide during combustion under oxidizing conditions. It has been stated also that combustion at conventional temperatures using diesel fuel with pyridine or quinoline results in the in the formation of substantially the same amount of nitric oxide as the burning of an equivalent amount of commercial propane to which has been added an equivalent amount of nitrogen in the form of ammonia. Tests have confirmed that the ordinary combustion of commercial propane containing 0.9 percent nitrogen by weight as ammonia produces almost (about 92%) as much nitrogen oxides as is formed in the ordinary combustion products of diesel fuel containing 0.9 percent nitrogen by weight as pyridine. Accordingly, the efficacy of the process of the present invention has been tested and demonstrated using standardized fuel feeds in which "dirty" fuels are exemplified by adding predetermined amounts of ammonia to a typical gaseous fuel such as commercial propane and by adding predetermined amounts of pyridine to a typical liquid fuel such as number 2 diesel fuel of low nitrogen content.

The choice of catalyst for inclusion in the first stage, and in the second stage when desired, of the combustion system of the present invention may depend on the inlet temperature of the fuel-air mixture, the catalyst temperature, the adiabatic reaction temperature of the mixture, the need for adequate thermal stability over desired periods of operation at the operating temperature of the catalyst, and generally on the ignition and activity characteristics dictated by the combustion mixtures, temperatures, flow rates, and combustor geometry. Oxidation catalysts containing a base metal such as cerium, chromium, copper, manganese, vanadium, zirconium, nickel, cobalt, or iron, or a precious metal such as silver or a platinum group metal, may be employed. The catalyst may be of the fixed bed or fluid bed type. At relatively quite high inlet and combustion temperatures, one or more refractory bodies with gas flowthrough passages, or a bed of refractory spheres, pellets, rings, or the like, may serve adequately without inclusion of expensive materials having greater specific catalytic activity. Preferred catalysts for carrying out the abovementioned combustion method of application Ser. No. 358,411, for example at temperatures of the order of 2,000°-3,000° F, are bodies of the monolithic honeycomb type formed of a core of ceramic refractory material. For improved operating characteristics, or for use at lower inlet or catalyst temperatures, such a core may be provided with an adherent coating in the form of a calcined slip of active alumina, which may be stabilized for good thermal properties, to which preferably has been incorporated a catalytically active platinum group metal such as palladium or platinum or a mixture thereof. The need for high catalytic activity depends to a large extent on the temperature of the combustion mixture at the inlet to the catalyst. The lower the inlet temperature, the higher the activity usually required for stable operation of the combustion stage. This requirement may be most critical when the operating temperature of the catalyst also is relatively high, because thermal aging of a catalyst tends to raise the minimum temperature at which ignition of a feed mixture will occur after the catalyst has cooled.

The first combustion stage of the process of this invention utilizes one or more catalyst bodies. Combustion in the presence of a catalyst may be carried out conventionally, for example at combustion zone temperatures of the order of 1,000°-1,500° F. However, a preferred combustion process for use in the method of the present invention, as discussed further hereinbelow, is the catalytically supported thermal combustion process disclosed in the aforementioned Pfefferle application Ser. No. 358,411. The first combustion zone is supplied with a fuel-air mixture formed with an amount of air substantially less than the amount needed for complete combustion of all the combustible components in the fuel feed. In addition to avoiding oxidizing conditions, the use of a suitably fuel-rich mixture (taking into account its inlet temperature and inert components) causes the combustion zone temperature and the operating temperature of the catalyst to be below a temperature that would result in any substantial formation of oxides of nitrogen or other fixed nitrogen compounds, E.G., ammonia or hydrogen cyanide, from atmospheric nitrogen present in the fuel-air mixture. Ordinarily for avoiding substantial formation of fixed nitrogen compounds, the catalyst operating temperature in the first combustion zone should be no greater than about 3,100° to about 3,800° F, depending on the combustor pressure, amount of air in proportion to the stoichiometric amount, and the nature of the fuel. In this connection residence time of the gases at such temperatures in the catalyst-containing combustion zone also may determine the suitability of the mixture composition, since very short residence times may limit materially any marginal formation of fixed nitrogen compounds from atmospheric nitrogen.

In the first combustion stage utilizing a catalyst, the air-fuel ratio can, for example, be 0.1 times the stoichiometric ratio or even lower. Preferably, the air-fuel ratio utilized in the first combustion stage is less than about 0.7 times, and often preferably between about 0.2 and 0.5 times, the amount needed for complete combustion, facilitating rapid utilization of the available air while avoiding undesirable production of fixed nitrogen compounds such as nitrogen oxides. It will be appreciated that unreacted hydrocarbons as well as carbon monoxide and hydrogen may be present in the effluent when the air-fuel ratio is below about 0.3 times stoichiometric. In any event, it will be evident in view of the air-fuel ratios discussed above and shown (as air equivalence ratios for the first stage) in the tables of examples hereinbelow that, for practical operation of the combustion method of the invention, the amount of air in the fuel-air mixture supplied to the first combustion stage must be sufficient to support substantial combustion therein by reaction of the fuel with the oxygen in the air supplied, giving an accompanying substantial release of thermal energy.

When carrying out the two stage combustion of this application utilizing the preferred range of air-fuel ratios for the first stage, combustion in the first stage can be suitably carried out under essentially adiabatic conditions to produce an effluent of high thermal energy. In addition, when the amount of air in the first stage is 0.2 to 0.5 times stoichiometric, this combustion process can be suitably carried out without the necessity of cooling any part of the combustion system in order to assure that the first stage combustion zone operates below temperatures at which substantial oxidation of atmospheric nitrogen occurs. Thus both the fuel-rich first mixture in the first stage and a fuel-lean second mixture in the second stage may be combusted under essentially adiabatic conditions (i.e., the combustion zone temperature, and hence the operating temperature of the catalyst in the catalyst stage or stages, does not deviate, due to heat transfer from the combustion zone or catalyst, more than about 300° F, and more typically no more than about 150° F, from the adiabatic flame temperature of the mixture entering the combustion zone). Also when utilizing the preferred range of air-fuel ratios, the first stage can be suitably operated at high space velocities, e.g., about 0.05 to 10 or more million cubic feet per hour of combusted gas (at standard temperature and pressure) per cubic foot of catalyst-containing combustion zone volume. Thereby, means are provided for generating thermal energy at high rates in a two stage combustion apparatus of practical size, while minimizing the amounts of nitrogen oxides formed from both nitrogen-containing compounds in the fuel and the atmospheric nitrogen fed to the two stages of the process.

The second combustion stage of the process in accordance with this invention can utilize either thermal, that is, homogeneous, combustion, or combustion in the presence of a catalyst. The combustion may be carried out under essentially adiabatic conditions to produce a high energy effluent. If a catalyst is used, it can be of the same type as, or different from, the catalyst used in the first stage. For example, the second stage can comprise one or more catalysts of relatively low activity, such as screens and perforated plates of metal, e.g. stainless steel or Inconel, and uncoated ceramic honeycombs.

The effluent from the first stage is mixed with an additional amount of air at least sufficient for complete combustion of all combustible components remaining in that effluent to form a second combustible mixture. With certain arrangements the stoichiometric amount of air just sufficient for complete combustion might be used, for example, if heat is removed from the first effluent to decrease the temperature of the mixture of gases entering the second stage, or if the gases passing through the second stage are well mixed and heat is removed from the combustion zone not operated adiabatically. In any event, the second mixture is combusted in the second combustion zone below a temperature that would result in any substantial formation of oxides of nitrogen from atmospheric nitrogen ($N_2$).

The means for providing a fuel-rich, fuel-air feed mixture to the first combustion stage can be any conventional arrangement for intimately mixing at least a portion of the fuel with air and contacting the first stage catalyst with the resulting fuel-air mixture, including conventional compressed air supply and feed control and valving arrangements.

The means for adding additional air to the first stage effluent can suitably comprise one or more air nozzles, evenly spaced about a chamber connecting the first and second stages. Preferably, the nozzles are uniformly spaced about the chamber between the first and second stages so that the temperature and fuel concentration profiles of the resulting mixture of effluent gas from the first stage and additional air are optimized for combustion in the second stage. However, the means for adding the additional air should provide complete mixing of the additional air with the first stage effluent before any further combustion occurs. This result can be achieved by designing the chamber and air nozzles so that they promote the thorough mixing of the additional air with the first stage effluent and cause the gas velocity between the stages of the process to be in excess of the critical velocity for a stable flame. Thereby, the oxidation of atmospheric nitrogen to nitrogen oxides between the stages of this process will be minimized.

In carrying out the process of this application, operating temperatures may vary within rather wide limits, but the first and second stage combustion zone temperatures ordinarily are not above about 3,200° F (about 1,750° C). For example, the temperatures of the first and second stage effluents of this process can suitably be between about 1,000° F and 3,200° F (about 550°–1,750°

C). Preferably, for the adiabatic first stage, combustion temperatures of about 1,500° F to about 2,700° F (about 800°-1,500° C) are encountered, and temperatures of about 1,750°-3,000° F (about 950°-1,650° C) are found in the second stage. Also in this process, any combination of inlet temperatures to the individual stages, cooling of individual stages, and air-fuel ratios in the feed to the combustion process that will provide such operating temperatures can be suitably utilized.

When the aforementined catalytically supported thermal combustion is to be effected in the first stage combustion zone under essentially adiabatic conditions, a nitrogen-containing carbonaceous fuel, whether liquid or gaseous, is used to form an intimate admixture with air, and the combustion of this fuel-rich first mixture in the first combustion zone is characterized by the first mixture at the inlet to the catalyst having an adiabatic flame temperature such that, upon contact with the catalyst occupying at least a major portion and preferably all of the flow cross section of the first combustion zone, the operating temperature of the catalyst is substantially above the instantaneous auto-ignition temperature of the first mixture (defined herein and in application Ser. No. 358,411 to mean the temperature at which the ignition lag of the mixture entering the catalyst is negligible relative to the residence time in the combustion zone of the mixture undergoing combustion). Under these conditions sustained combustion of a portion of the fuel is effected at a rate surmounting the mass transfer limitation to form a first effluent. When the uncombusted carbonaceous fuel in the first effluent then is to be combusted by catalytically supported thermal combustion in the second stage, the first effluent is mixed with sufficient air to form a fuel-lean second mixture for combustion in the second combustion zone under essentially adiabatic conditions in the presence of a second catalyst, and the combustion in the second combustion zone is characterized by the second mixture at the inlet to the second catalyst having an adiabatic flame temperature such that, upon contact with the second catalyst, the operating temperature of that catalyst is substantially above the instantaneous auto-ignition temperature of the second mixture. Sustained combustion of the uncombusted fuel remaining in the second mixture thereby is effected at a rate surmounting the mass transfer limitation to form a second effluent of high thermal energy. The first and second mixtures preferably are formed and constituted to provide operating temperatures of each of the first and second combustion zone catalysts in the range of about 1,750°-3,200° F (about 950°-1750° C). The second combustion zone catalyst may not be required to be as active as the first catalyst, because generally the second catalyst receives a heated effluent from the first stage at all times during operation.

Also in carrying out the process of this application, particular pressure drops and air and fuel throughputs are not critical. For example, if desired, pressure drops of 10% or less of the total pressure can be utilized, and throughputs of 0.05 to 10 or more million cubic feet of total combusted gas (at standard temperature and pressure) per cubic foot of catalyst in the first stage per hour can be utilized.

Further in carrying out this process, the total amount of air can suitably comprise from about one to three times the stoichiometric amount required to completely oxidize the combustible carbonaceous components of the fuel. However, it is preferred, if the combustion process of this application is to be utilized for a furnace, that the overall amount of air fed to the system comprises between about 1 and 1.2 times the stoichiometric amount of air needed to completely oxidize the carbonaceous fuel and, if the combustion process of this application is to be utilized for a gas turbine, that the overall amount of air be from about 1.5 to about 2.7 times the stoichiometric amount of air.

Still further in this process, the velocity of the fuel-air mixture to the first stage is not critical and can suitably be any velocity in excess of the maximum flame-propagating velocity. For example, a suitable gas velocity is usually above about three feet per second but may be considerably higher depending upon such factors as temperature, pressure, and composition of the fuel-air feed.

The fuel-air feed to the first combustion stage or the additional air added to the first stage effluent, or both, in carrying out the process of this invention may be preheated in a conventional manner. However, if preheating of the fuel-air feed is carried out by preburning the feed, only controlled preburning should be utilized. By controlled preburning is meant that the temperature of the fuel-air feed at the inlet to the first stage catalyst of this process is raised to no more than about 1,000° C (about 1,850° F), preferably no more than about 700° C (about 1,300° F), by burning a portion of the available fuel before the first stage. In other words, a preliminary mixture of fuel and air is burned upstream of the catalyst to provide preheated gases for the fuel-air feed to the catalyst inlet, so that the feed mixture entering the catalyst has an elevated temperature within the desired range. The controlled preburning of this invention can be carried out catalytically or thermally in a conventional manner. Controlled preburning is particularly useful for providing temperatures at the inlet of the first stage catalyst that are sufficiently high to vaporize relatively heavy fuel feeds, such as shale oil, thus facilitating the provision of an intimate admixture of fuel and air to provide a homogeneous mixture at the inlet to the catalyst used in the first stage combustion zone. Controlled preburning also is useful for providing temperatures at the inlet of the catalyst in the first stage which are greater than the ignition temperature of the fuel feed used. In this regard, controlled preburning is particularly important when this combustion process is carried out with a fuel having a relatively high ignition temperature, such as methane, and when no means, such as a compressor, is available to preheat combustion air above ambient temperature.

The fuel-air feed to the first stage or the additional air added to the first stage effluent, or both, also may contain effluent gas from the second stage that has been recycled in a conventional manner after removal of energy therefrom. The stages of this process or the effluents from the stages also may be cooled in a conventional manner without departing from this invention.

Figure 2:
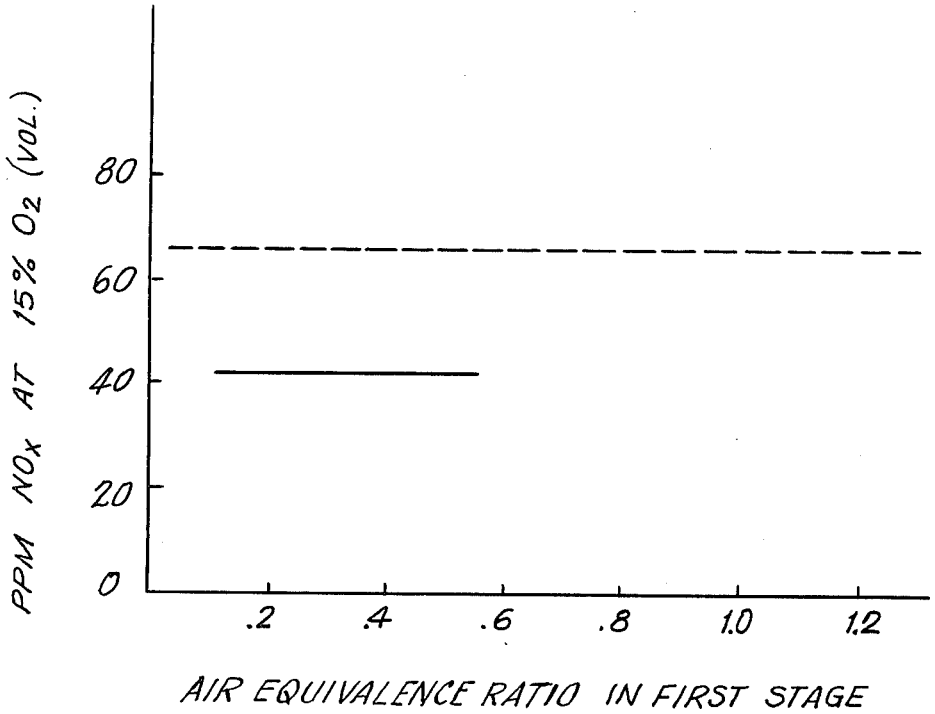
FIG. 2 is a graph comparing the amounts, in parts per million of effluent, of nitrogen oxides produced from fuel nitrogen and atmospheric nitrogen by two stage combustion in accordance with this invention, using fuels containing 0.17% (by weight) of nitrogen from nitrogen-containing compounds, with the amounts of nitrogen oxides which would be produced if all of the nitrogen-containing compounds in the fuel were converted to nitrogen oxides.

Referring to FIGS. 1 and 2, for convenience of presentation in the graphs, the air-fuel ratio of the mixture used in the first stage has been computed as the air equivalence ratio, which is defined as the ratio of the actual air-fuel ratio to the stoichiometric air-fuel ratio found in a mixture which comprises the stoichiometric amount of air. As seen from the graphs in FIGS. 1 and 2 and discussed further hereinbelow with respect to the examples which follow, the combustion process of this invention suppresses formation of nitrogen oxides from the nitrogen present in the "dirty" fuels used.

Under the conditions indicated in FIG. 1, the fuel nitrogen content of the fuel-air mixture combusted in the two stage process of the present invention was varied, and from about 25% to somewhat over 65% of the fuel nitrogen present was not converted to $NO_x$. With single stage operation, however, only about 6% to 13% of the fuel nitrogen failed to be converted to $NO_x$. In general utilizing the present process, some 20% to 65% of the nitrogen in the fuel is not oxidized to nitrogen oxides. In addition, by limiting combustion temperatures in both the first stage and the second stage, oxidation of the atmospheric nitrogen is substantially avoided.

Total production of $NO_x$ for a fuel containing a nitrogen compound supplying 0.17 weight percent nitrogen is shown in FIG. 2 for various air equivalence ratios, and the two stage method of the invention decreased the nitrogen oxide level in the effluent to less than two thirds of the level obtained if all fuel nitrogen were oxidized to $NO_x$.

The examples, summarized in the Tables which follow, further illustrate the process of this invention.

Figure 3:
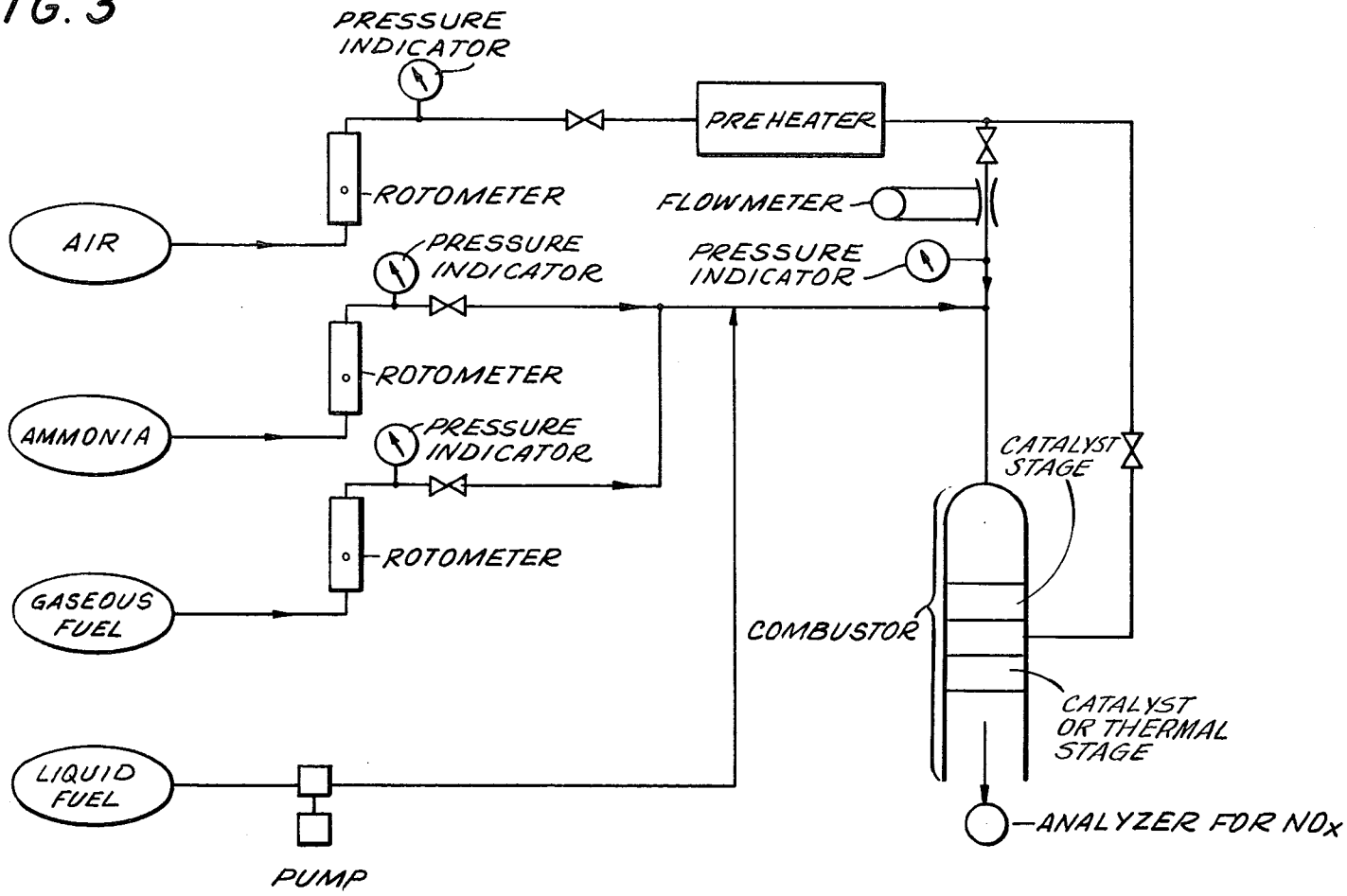
FIG. 3 is a flow chart of a two stage combustor suitable for carrying out the method of this invention, which was utilized to provide the experimental results in the Examples of this application.

In these examples, the fuels utilized were propane and diesel fuel. The nitrogen-containing impurity added to the propane was ammonia, and the nitrogen-containing impurity added to the diesel fuel as supplied as pyridine. The examples were carried out utilizing an apparatus substantially as shown in the flow chart in FIG. 3, in which multiple combustion stages are indicted within a single combustor housing. Examples involving a fuel-lean single stage combustion, identitied by the word "None" in place of second stage data, were carried out by feeding the fuel-lean mixture to the first catalyst-containing stage of the apparatus of FIG. 3. The other examples, involving a fuel-rich first stage and a fuel-lean second stage, were carried out by feeding the fuel-rich mixture to the first stage of the apparatus of FIG. 3 and adding additional air to the first stage effluent before passage to the second stage, which may be a thermal combustor or may contain a catalyst. In most of the examples an overall or total air-fuel ratio of about 38, i.e., about 142% excess air, was used.

In each example the first stage comprised a palladium oxidation catalyst on a slip-coated, monolithic honeycomb substrate. The honeycomb was disposed within a metal housing with a nominal two inch diameter and had parallel flow channels about one inch in length extending through the honeycomb. The honeycomb also had approximately 100 flow channels per square inch of cross section, with the walls between channels having a thickness of about 0.01 inch. The catalyst consisted of a zircon-mullite honeycomb which carried about 12% by weight of a stabilized calcined slip, containing primarily alumina and also chromia and ceria, which in turn carried about 0.2% (of the total weight) of palladium. The catalyst-containing first stage was arranged and operated as described in the aforementioned Pfefferle application Ser. No. 358,411.

In each example, the second stage contained a refractory catalyst of either a high activity type or a simple ceramic type. In the single stage examples shown for comparison, the first stage effluents simply passed through the intervening mixing zone without introduction of secondary air and on through the second stage to the output and analyzer section. The simple ceramic type when used in the second stage was a zircon-mullite honeycomb of the type described above in connection with the first stage, which was disposed within a metal housing and had a nominal 2 inch diameter and parallel flow channels of about 1 inch in length extending through it. However, the catalyst body in these examples contained no calcined slip or palladium catalyst material, and for convenience may be designated as uncoated. The catalyst when used in the highly active form in the second stage comprised active palladium catalyst material on a slip-coated zircon-mullite honeycomb, as described above in connection with the first stage catalyst, and this type of treated monolithic catalyst conveniently may be designated as coated.

Also in each example, air-fuel ratios were computed by weight, temperatures were measured in degrees Centigrade, and emissions were measured in parts per million (ppm) by volume. The space velocities in each example were calculated based on standard temperature (25° C) and pressure (one atmosphere). The examples were carried out with no heat being withdrawn from either of the combustion stages or from the chamber between the stages, except for the usual unavoidable heat losses, so that both stages and the entire apparatus operated under essentially adiabatic conditions.

In the examples illustrating single stage operation (designated "None" for the second stage in the Tables), the air in the feed to the combustor was preheated so that the combustor inlet temperature was between 340° C and 360° C (somewhat higher in Example 5 and somewhat lower in Example 17). In these single stage examples, the catalyst operated at temperatures in the approximate range of 1,100° C to 1,450° C (approximately 2,000°-2,650° F).

In the two stage combustion method of the invention, the first fuel-air mixture, fed to the first stage, is preheated to between about 300° C and about 1,000° C, that is, to about 550°-1,850° F, but preferably to a temperature below about 700° C (about 1,300° F) as noted hereinabove. When utilizing the two combustion stages in accordance with the invention, the operating temperature of the catalyst in the first combustion zone or stage preferably is maintained in the range of about 800°-1,750° C (about 1,500°-3,200° F). In the two stages examples described in the following Tables, the first combustor stage catalyst operated at estimated temperatures in the range of approximately 800°-1,100° C (about 1,500°-2,000° F), and the inlet temperature to the second stage was in the range of approximately 900°-1,000° C (about 1,650°-1,850° F). In many of these two stage examples the temperature of the fuel-air mixture at the inlet to the first stage catalyst was in the approximate range of 375°-500° C (about 700°-950° F). In another, at times advantageous, mode of operation the fuel-air mixture fed to the first combustor stage is preheated more extensively to between about 700° C and 1,000° C, that is, to about 1,300°-1,850° F. Thus Examples 18-20 involved some thermal preburning of the fuel-air mixture after entering the combustor apparatus as designated generally in FIG. 3 but before reaching the catalyst, so that the fuel-air mixture at the catalyst inlet, that is at the point of initiation of combustion in the presence of the catalyst, was about 350° C hotter than the mixture entering the combustor. In Examples 7 and 14 there was more extensive preburning between the combustor inlet and the inlet to the catalyst itself, and catalyst inlet temperatures were estimated at 932° C and 890° C respectively. Some preburning was employed also in other examples.

As seen from the results of the two stage examples in the following Tables, substantial decreases in the concentration of nitrogen oxides in the effluent from the combustion of a nitrogen-containing fuel were achieved by providing a first combustion zone or stage containing the catalyst and operating fuel rich with an amount of air no greater than about 0.7 times the amount needed for complete combustion of all the combustible carbonaceous components in the fuel, that is, an air-fuel ratio by weight of about 11 or less for propane and about 10.5 or less for diesel fuel, and by providing a second combustion zone or stage usually operating substantially fuel-lean. In a preferred form of the method of the invention, the first fuel-air mixture, fed to the first stage, is formed with an amount of air between about 0.2 and 0.5 times the amount needed for complete combustion. Preferably, also, the second mixture, formed by mixing the first stage effluent with an additional amount of air at least sufficient for complete combustion of all combustible components still remaining in the first stage effluent, is combusted at a temperature between about 950° C and about 1,650° C, that is at about 1,750°-3,000° F. The total amount of air in the mixtures fed to the first and second stages preferably is between about 1.5 and about 2.7 times the amount needed for complete combustion of all the combustible components in the fuel to provide an effluent particularly suitable for driving a turbine.

These examples show that, for fuels with nitrogen-containing compounds in the approximate range of one-half percent to one percent nitrogen by weight, some 80% to 90% of the nitrogen will be released as nitrogen oxides in the effluent from a single stage combustor, as compared with only about 35% to 55% appearing as nitrogen oxides in the effluent of the two stage combustor operating fuel-rich in the first stage. Likewise, with nitrogen-containing compounds present from somewhat over one-tenth to about one-quarter of one percent nitrogen by weight in the fuel, some 85% to practically all of the fuel nitrogen will be released as nitrogen oxides when burned in the single stage combustor, while relatively much smaller proportions of about 50% to 80% appeared as nitrogen oxides in the effluent when the combustor operated in two stages. With fuels having nitrogen-containing compounds in intermediate amounts of roughly one-quarter to one-half percent nitrogen by weight, as little as 40%, and in any event well under 70%, of the fuel nitrogen can be expected to appear as nitrogen oxides in the effluent using the two stage method, while most of the fuel nitrogen again will appear as nitrogen oxides in the effluent of the single stage combustor. The examples also demonstrate that these very substantial decreases in nitrogen oxide emissions can be obtained over a wide range of operating variables, such as space velocity, fuel-rich feed to the first stage catalyst, fuel nitrogen content, combustor outlet temperatures, pressure drop, controlled preburning of the feed, and the use in the second stage of various types of catalysts.

Table of Examples

| Example | 1 | 2 | 3 | 4 | 5 | 6 | 7 |
|---|---|---|---|---|---|---|---|
| First Stage, With Catalyst | | | | | | | |
| Space Velocity (hr.$^{-1}$) | 206,000 | 64,000 | 42,000 | 59,000 | 128,000 | 131,000 | 70,000 |
| Air Flow (lb./hr.) | 77.7 | 7.4 | 4.4 | 7.4 | 49.4 | 49.4 | 8.9 |
| Fuel Flow (lb./hr.) | 2.1* | 2.3* | 2.3* | 1.2* | 1.26** | 1.3* | 1.3* |
| Wt. N in Fuel, % | 0.87 | 0.8 | 0.8 | 0.91 | 0.94 | 0.83 | 0.83 |
| Air/Fuel Ratio (wt.) | 37.0 | 3.2 | 1.9 | 6.2 | 39.3 | 38.0 | 6.9 |
| Air Equivalence Ratio | 2.36 | 0.204 | 0.121 | 0.395 | 2.72 | 2.42 | 0.439 |
| Catalyst Inlet Temp. (° C) | 340 | 480 | 510 | 640 | 390 | 350 | 932 |
| Second Stage | None | | | | None | None | |
| Catalyst | | Uncoated | Uncoated | Uncoated | | | Uncoated |
| Inlet Temperature (° C) | | 900 | 990 | 965 | | | 1000 |
| Space Velocity (hr.$^{-1}$) | | 566,000 | 566,000 | 333,000 | | | 359,000 |
| Air Flow (lb./hr.) | | 70.2 | 73.3 | 31.9 | | | 40.5 |
| Total Air Flow (lb./hr.) | 77.7 | 77.6 | 77.7 | 39.3 | 49.4 | 49.4 | 49.4 |
| Total Air/Fuel Ratio (wt.) | 37.0 | 33.8 | 33.8 | 32.8 | 39.3 | 38.0 | 38.0 |
| Overall Air Equivalence Ratio | 2.36 | 2.15 | 2.15 | 2.09 | 2.72 | 2.42 | 2.42 |
| Outlet Data | | | | | | | |
| Outlet Temperature (° C) | — | 960 | 1155 | 1385 | 1200 | 1190 | 1200 |
| Emissions - CO (ppm) | — | 51 | 34 | 48 | 7.8 | — | 55 |
| " - HC (ppm) | — | 6 | 4 | — | 3.0 | 4 | 4 |
| " - $NO_x$ (ppm) | 390 | 175 | 210 | 275 | 450 | 380 | 150 |
| Yield of N to $NO_x$,% | 81.6 | 36.7 | 44.0 | 49.0 | 90.6 | 86.1 | 34.0 |

| Example | 8 | 9 | 10 | 11 | 12 | 13 | 14 |
|---|---|---|---|---|---|---|---|
| First Stage, With Catalyst | | | | | | | |
| Space Velocity (hr.$^{-1}$) | 193,000 | 90,000 | 191,000 | 80,000 | 50,000 | 131,000 | 50,000 |
| Air Flow (lb./hr.) | 73.0 | 11.2 | 73.1 | 11.4 | 19.2 | 49.4 | 6.4 |
| Fuel Flow (lb./hr.) | 2.0* | 2.0* | 2.7** | 2.7** | 2.8* | 1.3* | .92* |
| Wt. N in Fuel, % | 0.99 | 0.99 | 0.94 | 0.94 | 0.71 | 0.16 | 0.16 |
| Air/Fuel Ratio (wt.) | 36.4 | 5.6 | 27.1 | 4.2 | 6.9 | 38.0 | 7.0 |
| Air Equivalence Ratio | 2.32 | 0.357 | 1.88 | 0.290 | 0.439 | 2.42 | 0.440 |
| Catalyst Inlet Temp. (° C) | 350 | 400 | 350 | 380 | 460 | 345 | 890 |
| Second Stage | None | | None | | | None | |
| Catalyst | | Coated | | Coated | Coated | | Uncoated |
| Inlet Temperature (° C) | | 690 | | 1085 | 1155 | | 87 |
| Space Velocity (hr.$^{-1}$) | | 532,000 | | 523,000 | 563,000 | | 255,00 |
| Air Flow (lb./hr.) | | 61.9 | | 61.9 | 57.7 | | 28. |
| Total Air Flow (lb./hr.) | 73.0 | 73.1 | 73.1 | 73.3 | 76.9 | 49.4 | 35. |
| Total Air/Fuel Ratio (wt.) | 36.4 | 36.6 | 27.1 | 27.1 | 27.5 | 38.0 | 38. |
| Overall Air Equivalence Ratio | 2.32 | 2.33 | 1.88 | 1.88 | 1.75 | 2.42 | 2.4 |
| Outlet Data | | | | | | | |
| Outlet Temperature (° C) | 1220 | 1470 | 1445 | 1295 | 1255 | 1100 | 1060 |
| Emissions - CO (ppm) | 2.5 | — | 7 | — | 6.5 | 4 | — |
| " - HC (ppm) | — | — | — | — | — | 8 | 2.5 |
| " - $NO_x$ (ppm) | 475 | 200 | 605 | 380 | 180 | 86 | 59 |
| Yield of N to $NO_x$,% | 86.0 | 36.2 | 86.3 | 54.4 | 34.5 | 98.2 | 68.0 |

| Example | 15 | 16 | 17 | 18 | 19 | 20 |
|---|---|---|---|---|---|---|
| First Stage, With Catalyst | | | | | | |

-continued

| Table of Examples | | | | | | |
|---|---|---|---|---|---|---|
| Space Velocity (hr.$^{-1}$) | 193,000 | 90,000 | 187,000 | 50,000 | 70,000 | 50,000 |
| Air Flow (lb./hr.) | 73.0 | 11.2 | 76.9 | 19.2 | 8.4 | 6.0 |
| Fuel Flow (lb./hr.) | 2.0* | 2.0* | 2.3* | 3.0* | 2.1* | 1.5* |
| Wt. N in Fuel, % | 0.19 | 0.22 | 0.17 | 0.15 | 0.17 | 0.17 |
| Air/Fuel Ratio (wt.) | 36.4 | 5.6 | 33.4 | 6.4 | 4.0 | 4.0 |
| Air Equivalence Ratio | 2.32 | 0.356 | 2.13 | 0.408 | 0.255 | 0.255 |
| Catalyst Inlet Temp. (° C) | 345 | 405 | 304 | 700 | 700 | 710 |
| Second Stage | None | | None | | | |
| Catalyst | | Coated | | Coated | Uncoated | Uncoated |
| Inlet Temperature (° C) | | 720 | | 1185 | 1065 | 975 |
| Space Velocity (hr.$^{-1}$) | | 532,000 | | 564,000 | 590,000 | 421,000 |
| Air Flow (lb./hr.) | | 61.9 | | 57.7 | 72.4 | 51.9 |
| Total Air Flow (lb./hr.) | 73.0 | 73.1 | 76.9 | 76.9 | 80.8 | 57.0 |
| Total Air/Fuel Ratio (wt.) | 36.4 | 36.6 | 33.4 | 25.6 | 38.5 | 38.6 |
| Overall Air Equivalence Ratio | 2.32 | 2.33 | 2.13 | 1.63 | 2.45 | 2.46 |
| Outlet Data | | | | | | |
| Outlet Temperature (° C) | 1215 | 1465 | 1360 | 1260 | 1265 | 1270 |
| Emissions - CO (ppm) | 2.5 | — | 7.5 | 10.0 | — | 40 |
| " - HC (ppm) | — | — | 2.5 | 2.0 | — | 3 |
| " - $NO_x$ (ppm) | 88 | 68 | 135 | 63 | 68 | 70 |
| Yield of N to $NO_x$,% | 83.5 | 54.5 | 100.0 | 53.5 | 74.5 | 79.0 |

*Propane containing ammonia.
**Diesel fuel containing pyridine.

What is claimed is:

1. The method of combusting nitrogen-containing fuel while suppressing formation of oxides of nitrogen from said nitrogen contained in the fuel, comprising:

forming a first mixture of said fuel and an amount of air substantially less than the amount needed for complete combustion of all the combustible components in said fuel but sufficient to support substantial combustion of said fuel;

combusting said first mixture in a first combustion zone in the presence of a catalyst, having an operating temperature below a temperature that would result in any substantial formation of oxides of nitrogen or other fixed nitrogen compounds from atmospheric nitrogen present in said mixture, to form a first effluent;

mixing said first effluent with an additional amount of air at least sufficient for complete combustion of all combustible components remaining in said first effluent to form a second mixture;

and combusting said second mixture in a second combustion zone below a temperature that would result in any substantial formation of oxides of nitrogen from atmospheric nitrogen.

2. The method of claim 1, wherein said nitrogen-containing fuel comprises about one-twentieth percent to about one percent nitrogen by weight in the form of oxidizable, nitrogen-containing compounds.

3. The method of claim 1, wherein the operating temperature of the catalyst in said first combustion zone is below about 3,200° F.

4. The method of claim 1, wherein said first mixture is formed of said fuel and an amount of air less than about 0.7 times the amount needed for complete combustion of all the combustible components in said fuel.

5. The method of claim 1, wherein said second mixture is combusted in said second combustion zone at a temperature below about 3,200° F.

6. The method of claim 1, wherein said first mixture is combusted under essentially adiabatic conditions in said first combustion zone.

7. The method of claim 6, wherein said first mixture is formed with an amount of air between about 0.2 and 0.5 times the amount needed for complete combustion.

8. The method of claim 6, wherein the operating temperature of the catalyst in said first combustion zone is between about 1,500° and about 3,200° F.

9. The method of claim 8, wherein said second mixture is combusted at a temperature between about 1,750° and about 3,000° F.

10. The method of claim 1, wherein said first mixture and said second mixture are combusted under essentially adiabatic conditions.

11. The method of claim 1, wherein said second mixture is combusted thermally in said second combustion zone.

12. The method of claim 1, wherein said second mixture is combusted in said second combustion zone in the presence of a second catalyst.

13. The method of claim 1, wherein the total amount of air in said first and second mixtures is between about 1.5 and about 2.7 times the amount needed for complete combustion of all the combustible components in said fuel.

14. The method of claim 1, wherein the first mixture is preheated to between about 550° and about 1,850° F.

15. The method of claim 1, wherein the first mixture is preheated to between about 550° and about 1,300° F.

16. The method of claim 1, wherein a preliminary mixture of fuel and air is burned upstream of the catalyst to provide preheated gases for said first mixture, said first mixture having a temperature between about 550° and about 1850° F.

17. The method of claim 1, wherein a portion of the final effluent from said second combustion zone is cooled and mixed with said first effluent to recycle said cooled portion of the final effluent.

18. The method of combusting nitrogen-containing carbonaceous fuel while suppressing formation of oxides of nitrogen from said nitrogen contained in the fuel, comprising:

forming a first mixture of said fuel in intimate admixture with an amount of air substantially less than the amount needed for complete combustion of all the combustible components in said fuel but sufficient to support substantial combustion of said fuel;

combusting said first mixture under essentially adiabatic conditions in a first combustion zone in the presence of a catalyst to form a first effluent, the combustion in said first combustion zone being characterized by said first mixture having an adiabatic flame temperature such that, upon contact with said catalyst, the operating temperature of said catalyst is substantially above the instantaneous auto-ignition temperature of said first mixture but below a temperature that would result in any substantial formation of oxides of nitrogen or other fixed nitrogen compounds from atmospheric nitrogen present in said mixture thereby effecting sustained combustion of a portion of said fuel at a rate surmounting the mass transfer limitation;

mixing said first effluent with an additional amount of air at least sufficient for complete combustion of all combustible components remaining in said first effluent to form a second mixture;

and combusting said second mixture in a second combustion zone below a temperature that would result in any substantial formation of oxides of nitrogen from atmospheric nitrogen.

19. The method of claim 18, wherein said first effluent is mixed with sufficient air to form a fuel-lean second mixture for combustion in said second combustion zone under essentially adiabatic conditions in the presence of a second catalyst, and said combustion in said second combustion zone is characterized by said second mixture having an adiabatic flame temperature such that, upon contact with said second catalyst, the operating temperature of said second catalyst is substantially above the instantaneous auto-ignition temperature of said second mixture thereby effecting sustained combustion of the uncombusted fuel in said second mixture at a rate surmounting the mass transfer limitation to form a second effluent of high thermal energy.

20. The method of claim 18, wherein the operating temperature of the catalyst in said first combustion zone is between about 1,750° and about 3,200° F.

21. The method of claim 19, wherein the operating temperatures of the catalyst in said first combustion zone and of the second catalyst in said second combustion zone are individually between about 1,750° F and about 3,200° F.

22. The method of claim 18, wherein said first mixture is formed with an amount of air between about 0.2 and 0.7 times the amount needed for complete combustion.

23. The method of claim 1, wherein said first effluent is cooled prior to passage into said second combustion zone.

* * * * *

UNITED STATES PATENT AND TRADEMARK OFFICE

CERTIFICATE OF CORRECTION

PATENT NO. : 4,054,407

DATED : October 18, 1977

INVENTOR(S) : R. V. Carrubba, R. M. Heck and G. W. Roberts

It is certified that error appears in the above-identified patent and that said Letters Patent are hereby corrected as shown below:

In Col. 1, line 42, after "course" insert --coal and--.

In Col. 4, line 25, delete "the" and substitute --that--.

In Col. 4, line 48, after "as" insert --a--.

In Col. 11, line 28, delete "as" (second occurrence) and substitute --was--.

In Col. 11, line 31, "indicted" should be --indicated--.

In Col. 11, line 33, "identitied" should be --identified--.

In Col. 12, line 43 "stages" should be --stage--.

In Col. 14, in the Table of Examples, at the bottom of the column, Example 14, change the following numbers:

In line 6, "0.440" should be changed to --0.446--.

In line 10, "87"should be changed to --875--.

In line 11, "255,00" should be changed to --255,000--.

In line 12, "28." should be --28.7--.

In line 13, "35." should be changed to --35.1--.

UNITED STATES PATENT AND TRADEMARK OFFICE

CERTIFICATE OF CORRECTION

PATENT NO. : 4,054,407

DATED : October 18, 1977

INVENTOR(S) : R. V. Carrubba, R. M. Heck and G. W. Roberts

It is certified that error appears in the above-identified patent and that said Letters Patent are hereby corrected as shown below:

In Col. 14, Table of Examples,

In line 14, "38." should be changed to --38.2--.

In line 15, "2.4" should be changed to --2.43--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*